US010648281B2

(12) United States Patent
Vavik

(10) Patent No.: US 10,648,281 B2
(45) Date of Patent: May 12, 2020

(54) DRILLING RISER PROTECTION SYSTEM

(71) Applicant: FUTURE WELL CONTROL AS, Kristiansand (NO)

(72) Inventor: Dag Vavik, Kristiansand (NO)

(73) Assignee: FUTURE WELL CONTROL AS, Kristiansand (NO)

( * ) Notice: Subject to any disclaimer, the term of this patent is extended or adjusted under 35 U.S.C. 154(b) by 0 days.

(21) Appl. No.: 15/537,886

(22) PCT Filed: Nov. 12, 2015

(86) PCT No.: PCT/NO2015/050211
§ 371 (c)(1),
(2) Date: Jun. 20, 2017

(87) PCT Pub. No.: WO2016/105205
PCT Pub. Date: Jun. 30, 2016

(65) Prior Publication Data

US 2017/0350213 A1 Dec. 7, 2017

(30) Foreign Application Priority Data

Dec. 22, 2014 (NO) ..... 20141553

(51) Int. Cl.
*E21B 34/08* (2006.01)
*E21B 21/08* (2006.01)
(Continued)

(52) U.S. Cl.
CPC ..... *E21B 34/08* (2013.01); *E21B 17/01* (2013.01); *E21B 21/001* (2013.01); *E21B 21/08* (2013.01);
(Continued)

(58) Field of Classification Search
CPC ..... E21B 34/08; E21B 34/063; E21B 17/01; E21B 21/08; E21B 21/103; E21B 33/064
See application file for complete search history.

(56) References Cited

U.S. PATENT DOCUMENTS 6,470,975 B1 * 10/2002 Bourgoyne ..... E21B 21/001 166/367
7,331,393 B1 * 2/2008 Hoel ..... E21B 33/072 166/250.01
(Continued)

FOREIGN PATENT DOCUMENTS

WO WO 2009/123476 A1 10/2009
WO WO 2013/153135 A2 10/2013
WO WO-2013153135 A2 * 10/2013 ..... E21B 21/08

OTHER PUBLICATIONS

J. Dewar et al.: "Procedures control total mud losses while drilling in deep water", Oil & Gas Journal, vol. 91, No. 44, pp. 67-69, 72-73 (1993).
J. W. Barker et al.: "Formation of Hydrates During Deepwater Drilling Operations", Journal of Petroleum Technology, SPE paper 16130-PA, pp. 297-301 (1989).

*Primary Examiner* — Matthew R Buck
*Assistant Examiner* — Aaron L Lembo
(74) *Attorney, Agent, or Firm* — Norman B. Thot

(57) ABSTRACT

A protection system for a drilling riser. The drilling riser includes a main drilling riser bore and a drilling riser annulus and extends from a floating installation to a location on a seafloor and is fluidly connected to a subsea BOP. The system includes a fluid conduit which extends from the floating installation to a lower region of the drilling riser. The fluid conduit is fluidly connected with the drilling riser annulus in the drilling riser. The fluid conduit provides at least one of a rapid pressure relief and a fluid bypass for the main drilling riser bore to prevent the drilling riser from an uncontrolled pressure build-up due to an inadvertent plugging or a restriction resulting in a maximum allowable
(Continued)

working pressure (MAWP) of the drilling riser being exceeded, if a restriction, a plug or a blockage exists in the drilling riser annulus or in riser outlets.

14 Claims, 3 Drawing Sheets

(51) Int. Cl.

| | |
|---|---|
| ***E21B 21/00*** | (2006.01) |
| ***E21B 17/01*** | (2006.01) |
| ***E21B 21/10*** | (2006.01) |
| ***E21B 34/06*** | (2006.01) |
| *E21B 33/064* | (2006.01) |

(52) U.S. Cl.
CPC ..... *E21B 21/103* (2013.01); *E21B 34/063* (2013.01); *E21B 33/064* (2013.01)

(56) References Cited

U.S. PATENT DOCUMENTS

| | | | | |
|---|---|---|---|---|
| 7,637,326 | B2 * | 12/2009 | Bolding | E21B 43/25 166/322 |
| 7,770,653 | B2 * | 8/2010 | Hill | E21B 34/02 166/379 |
| 9,759,025 | B2 * | 9/2017 | Vavik | E21B 21/001 |
| 9,828,847 | B2 * | 11/2017 | Vavik | E21B 47/0001 |
| 2008/0105434 | A1 | 5/2008 | Orbell et al. | |
| 2011/0100710 | A1 | 5/2011 | Fossli | |
| 2012/0227978 | A1 * | 9/2012 | Fossli | E21B 21/001 166/363 |
| 2015/0068758 | A1 | 3/2015 | Leuchtenberg et al. | |
| 2017/0122046 | A1 * | 5/2017 | Vavik | E21B 21/001 |
| 2017/0138170 | A1 * | 5/2017 | Vavik | E21B 47/0001 |

* cited by examiner

DRILLING RISER PROTECTION SYSTEM

CROSS REFERENCE TO PRIOR APPLICATIONS

This application is a U.S. National Phase application under 35 U.S.C. § 371 of International Application No. PCT/NO2015/050211, filed on Nov. 12, 2015 and which claims benefit to Norwegian Patent Application No. 20141553, filed on Dec. 22, 2014. The International Application was published in English on Jun. 30, 2016 as WO 2016/105205 A1 under PCT Article 21(2).

FIELD

The present invention relates to a protection system for a marine drilling riser. More specifically, the present invention relates to a system which protects the riser from overpressure in case of gas hydrates formed either in the wellbore, wellhead, subsea BOP or in the drilling riser annulus, agglomerates and adhere between the drill pipe and drilling riser main bore wall plugging the entire drilling riser annulus. The system will also protect the riser from overpressure if all outlets from the riser are restricted, plugged or blocked with hydrates or other substances or for some other reasons.

BACKGROUND

As the oil and gas industry are going to deeper water inadvertent gas entry into the drilling riser is a challenge due to that the high static pressure at the seabed causes the gas to be highly compressed and in dense phase. Another challenge is that due to the static high pressure and low seawater temperature any gases that may enter the wellhead, subsea BOP, riser annulus and K&C (kill and choke) lines may form hydrates. Hydrates can form if gas and water are both present and the pressure is relative high and temperature relative low. Hydrates have a strong tendency to agglomerate and to adhere to the pipe wall and thereby plug the pipe or riser annulus.

There are known several case stories on how hydrates have caused problems during deep water drilling and well control operations. In 1989 an SPE paper was published with two case stories with formation of hydrates during deep water drilling operations.

SPE paper 16130-PA; Formation of Hydrates During Deepwater Drilling Operations. Authors: J. W. Barker, SPE and R. K. Gomez, SPE, Exxon Co. U.S.A. Journal of Petroleum Technology, March 1989.

Case 1. US west coast 1,150 ft (350 m) water depth, temp. 45° F. (7° C.) at mudline.

- Gas from a sand formation at 7,750 ft (2362 m), was channelling up through a primary cement column and migrated up the (7"×9⅝") casing annulus.
- The wellhead hanger packer was leaking, allowing the migrating gas to enter the freshwater mud at the subsea wellhead.
- After the conclusion of the kill operation, approximately 7 days after gas was first detected, both the choke- and kill line were found plugged.
- After cementing operations, which secured the wellbore, the BOP stack was recovered. Hydrates and trapped gas were found in the choke- and kill line for the bottom eight riser joints.

Case 2. Gulf of Mexico 3,100 ft (945 m) water depth, temp. 40° F. (4° C.) at mudline.

- After drilling to 7,679 ft (2340 m), the well was found flowing during a flow check.
- During the attempt to establish circulation after shut-in, returns could not be established and casing pressure fell to zero.
- Fourteen hours after the kick was first detected, all BOP's were opened to observe the well, which appeared static.
- Almost 30 hours after initial shut-in, the well flowed again and the BOP's were closed. Part of the gas influx above the closed BOP's continued to migrate up the riser and was successfully diverted.
- The choke-line was determined to be plugged during subsequent attempts to circulate mud (down the choke-line and) up the riser above a closed ram-type BOP.
- The kill line also may have been plugged because it was not checked at this time.
- With no apparent well pressure the, the BOP's were again opened to monitor the well.
- Almost 48 hours after the initial well kick, the well flowed a third time. After an annular BOP was closed, the lower middle ram-type BOP was actuated to prepare for drillstring hangoff; however, it did not take the proper amount of closing fluid.
- The lower most ram-type BOP was then closed.
- The riser continued to flow mud and gas that was successfully diverted overboard.
- During subsequent attempts to fill the riser, the kill line was determined to be plugged.
- During pulling of the riser and BOP's, hydrates were recovered from the choke-line and the kill line of the bottom riser joints.
- Testing of the BOP's at the surface indicated that failure of the ram-type BOP's to open fully or close fully on the ocean floor was not caused by mechanical failure or problems in the BOP control system.

Barker and Gomez have stated in 1989 based on the two cases above that; "Formation of natural gas hydrates during deepwater well-control operations can have several such adverse effects as:

1) Choke- and kill-line plugging, which prevents their use in well circulation.
2) Plug formation at or below the BOP's, which prevents well pressure monitoring below the BOP's.
3) Plug formation around the drillstring in the riser, BOP's, or casing, which prevent drillstring movement.
4) Plug formation between the drillstring and the BOP's, which prevents full BOP closure.
5) Plug formation in the ram cavity of a closed BOP, which prevents the BOP from fully opening."

Although the challenge with hydrates during drilling and well control operations has been known for many years, several cases with hydrates causing problems have also been reported after 1989.

A potential plug in the riser annulus is dangerous because if the BOP is closed in and the booster pump is used to circulate out the gas hydrates from the riser, the applied pressure from the booster pump may burst the drilling riser. It is also dangerous if liberated gas from above the plug may displace the liquid mud above and create a chain reaction creating a large differential pressure across the plug. If the hydrate plug for some reason then becomes loose it may accelerate up the riser fast and potentially plug all riser outlets as a secondary effect. An accelerating hydrate plug up the riser annulus may also release large amount of gas, increasing the pressure in the riser. This may then create an overpressure that may burst the slip joint or flow hoses in the upper part of the riser (in case of managed pressure drilling technics are used), resulting in a large gas release in the moon pool area.

SUMMARY

An aspect of the present invention is to prevent a hazardous event occurring from a "Plug formation around the drillstring in the riser".

Another aspect of the present invention is to provide a system which protects the riser from overpressure in case of outlets from the riser is/are plugged with hydrates or blocked for some other reason.

Another aspect of the present invention is to provide a system which is adaptable on new and existing installations and which requires as few modifications as possible.

In an embodiment, the present invention provides a protection system for a drilling riser. The drilling riser includes a main drilling riser bore and a drilling riser annulus and is configured to extend from a floating installation to a location on a seafloor and to be fluidly connected to a subsea BOP. The system includes a fluid conduit configured to extend from the floating installation to a lower region of the drilling riser. The fluid conduit is fluidly connected with the drilling riser annulus in the drilling riser. The fluid conduit is configured to provide at least one of a rapid pressure relief and a fluid bypass for the main drilling riser bore to prevent the drilling riser from an uncontrolled pressure build-up due to an inadvertent plugging or a restriction resulting in a maximum allowable working pressure (MAWP) of the drilling riser being exceeded, if a restriction, a plug or a blockage exists in the drilling riser annulus or in riser outlets.

BRIEF DESCRIPTION OF THE DRAWINGS

The present invention is described in greater detail below on the basis of embodiments and of the drawings in which.

DETAILED DESCRIPTION

Figure 1:
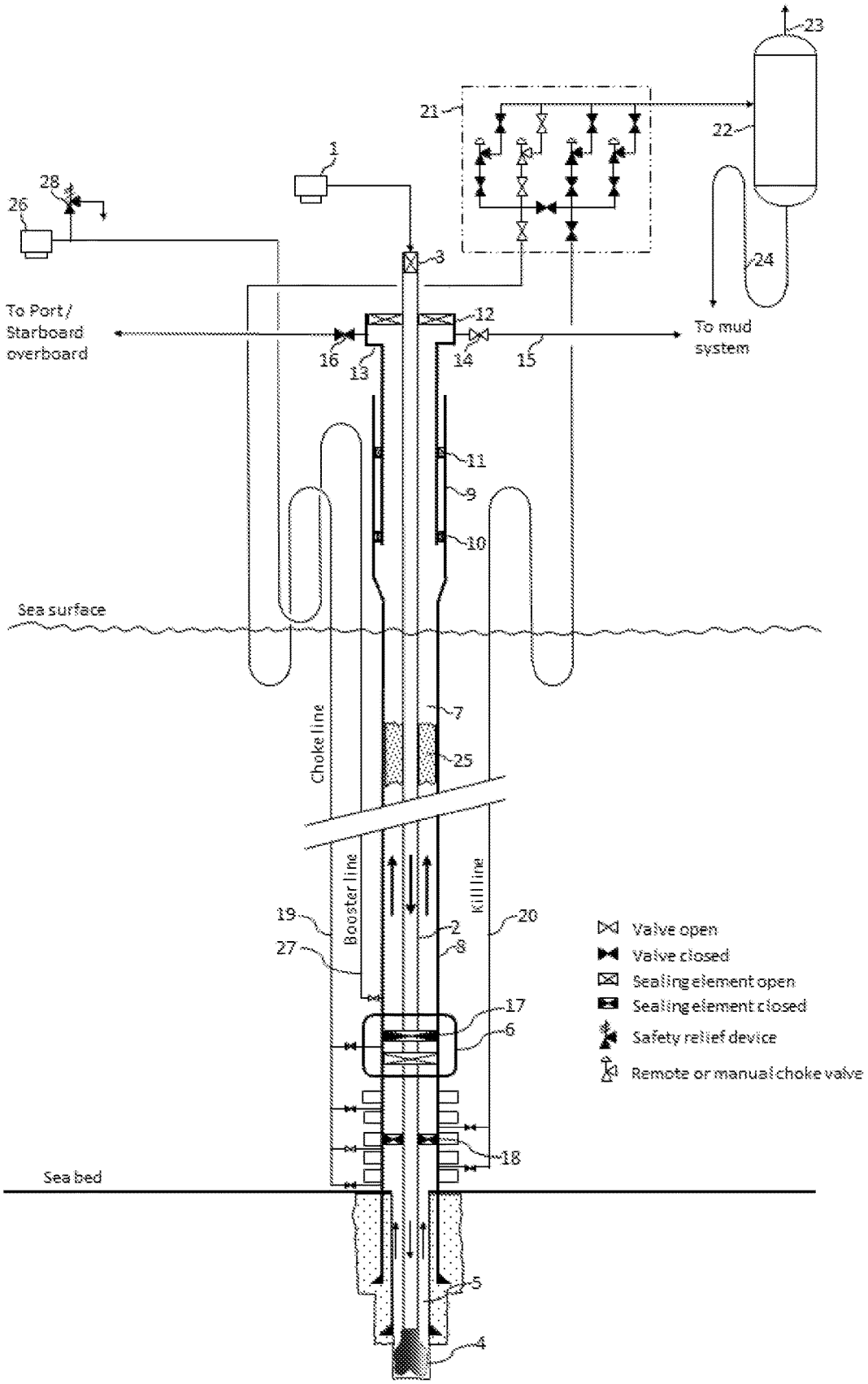
Fig. 1 (prior art)
FIG. 1 discloses a simplified schematic of an offshore system representing prior art comprising a floating installation and a drilling riser with associated kill, choke and booster line connected to a subsea BOP stack.

To protect the riser from overpressure, a fluid conduit is used as a secondary pressure protection system. The system should be a fully automated High Integrity Pressure Protection System (HIPPS), since there is normally not enough time for manual intervention and operating procedures.

Throughout the disclosure, the term "riser" and "drilling riser" have been used, the terms meaning the same, but even though the present invention is described in relation to a drilling operation, it should be understood that the present invention is applicable for other riser systems than just drilling risers, including completion systems (completion riser) and production systems (production riser).

The present invention relates to a protection system for a drilling riser provided with a main bore, where the drilling riser is arranged to extend between a floating installation and a blow out preventer (BOP) arranged on a seafloor, where the drilling riser is being fluidly connected to the BOP. The protection system further comprises a fluid conduit extending from the floating installation and to a lower region of the drilling riser, where the fluid conduit is being fluidly connected to an annulus provided in the drilling riser. The fluid conduit is used for rapid pressure relief and/or to bypass the main bore of the drilling riser in order to prevent the drilling riser from uncontrolled pressure build-up across an inadvertent plugging or restriction or in order to prevent a maximum allowable working pressure (MAWP) of the drilling riser to be exceeded, in the event the riser annulus or riser outlets is/are restricted, plugged or blocked.

In an aspect, for preventing hydrate plugging of the riser outlet, blow out preventer (BOP) or the choke and kill lines, there may be arranged at least one additional fluid line extending from a surface location to a lower region of the riser, which at least one additional fluid line may be connectable to the annulus of the riser and serves as a standby line being at least partly filled with a hydrate inhibitor. The degree of filling of the hydrate inhibitor fluid may vary from a small amount to filling up the whole additional fluid line. The hydrate inhibitor fluid is typically MEG (Monoethylene glycol) or other suitable inhibitor. By having the additional fluid line permanently filled with the hydrate inhibitor, provides for the opportunity of instant chemical injection in case of a gas kick. This option, in addition to circulating excess pressure (e.g. gas) gas out of the booster line at the same time, provides an effective system and method of handling/minimizing hydrate formation.

In an embodiment, the protection system may comprise facilities for displacing the hydrate inhibitor in the additional fluid line with seawater in a reversed way back to a topside storage facility if/when the well is completed or if the riser for some reason has to be pulled. This is done to prevent spilling hydrate inhibitor fluid on the topside facility.

A normal operation of the system according to the present invention may include:

- Close BOP when gas is encountered in the return flow from the well,
- Circulate out gas through pressure control manifold by boosting the riser annulus with fresh mud from the booster pump through the booster line, while keeping the BOP closed,
- If a sudden blockage occur during circulation of the gas, the result will be an increase in the booster pump pressure,
- The system shall then (automatically) shut down and stop the booster pump,
- Normally, the pressure PT shall drop equal to the frictional pressure drop caused by pumping through the booster line and annulus,
- If the pressure PT continues to increase again after pump is shut down, then this is due to expanding gas or melting of hydrates in top of the riser. The protection system shall then open the pressure relief valve (PRV) and release mud (fluids) to the mud gas separator (MGS), allowing the gas to expand in the riser and preventing the riser from being exposed to overpressure.

These and other characteristics of the present invention will be clear from the following description of an embodiment, given as a non-restrictive example, with reference to the attached drawings wherein:

FIG. 1 shows a simplified schematic of an offshore system representing prior art. At least one high pressure mud pump 1 (normally two or three) is used for pumping mud down a drill string 2, typically through a top drive (not shown) with and internal valve called IBOP 3. The mud is pumped down the drill string 2 and through the drilling bit 4 and up through the wellbore and casing annulus 5, through a subsea BOP stack and a lower marine riser package (LMRP) 6 and further through a drilling riser annulus 7, formed between the drill string 2 and an inner wall of a drilling riser 8. The mud will normally be returning through a slip joint 9, comprising one packer 10 which is normally closed and an secondary standby packer 11 which normally only get energized when a diverter element 12 is closed. From a diverter housing 13, the mud is normally returning through an open valve 14 fluidly connected to a flow line 15 back to the mud system (not shown).

In a well control event followed by gas inadvertently entering the riser 8, the inadvertent gas in the riser 8 may expand rapidly as the gas is circulated and migrating up the riser annulus 7. In such an emergency situation the gas and riser fluids can be diverted safely to port or starboard (leeward side) overboard lines by opening diverter valve(s) 16, closing the diverter element 12 and flow line valve 14. This divert overboard sequence is actuated manually but the sequence of operation is automated and interlocked to provide that the diverter valve 16 is open before the diverter element 12 closes around the drill string 2. Any hydrocarbon gas or influx that are trapped below a subsea blow out preventer (BOP) annular 17 or a subsea BOP ram 18, can be circulated out by pumping kill fluid down the drill string 2 and up through either a choke line 19 or the a kill line 20 to a kill & choke manifold 21 and to a mud gas separator 22, where the gas can be vented through a vent line 23 and the liquid can return through a liquid seal 24, back to the mud system.

One challenge with inadvertent hydrocarbon gas in the riser 8 is that it may react with the water in the drilling fluid and form hydrates. A booster pump 26 is normally used to circulate drilling fluid down a booster line 27 in order to circulate the hydrates out from the riser annulus 7. A potential hydrate plug 25 in the riser annulus is dangerous because if the BOP 18 is closed in, the applied pressure from the booster pump 26 may burst the drilling riser 8, since the ordinary safety relief valve 28 is set to protect the booster line 27. Typically set point for safety relief valve 28 will be 5000 psi or whatever is the max allowable working pressure for the booster line 27. In deep water and with high booster pump 26 flow rate, the frictional pressure drop in the booster line 27 can be as high as 4000 to 5000 psi. If the riser annulus or the outlets of the riser 8 are blocked for some reason, 5000 psi applied surface pressure may burst the riser 8, especially if the riser 8 in addition is filled with drilling fluid with higher density than the outside seawater.

It is also dangerous if liberated gas from the top of the hydrate plug 25 displace the liquid mud above and create a chain reaction creating a large differential pressure across the hydrate plug 25. If the hydrate plug 25 for some reason then become loose, it may accelerate up the riser annulus 7 fast and potentially plug the diverter housing 13 and all riser outlets as a secondary effect. A large hydrate plug 25 in the diverter housing 13 will be very dangerous because the liberated gas from the hydrate plug 25 will increase the pressure in the riser 8 and potentially burst the primary and secondary slip joint packers 10, 11, resulting in a large gas release in the moon pool area (not shown).

An aspect of the present invention is therefore to provide a system which protects the riser 8 and slip joint 9 from overpressure which may result in a riser 8 or slip joint 9 burst due to the release of entrapped gas during melting of hydrates, which is a risk with the prior art according to FIG. 1.

Figure 2:
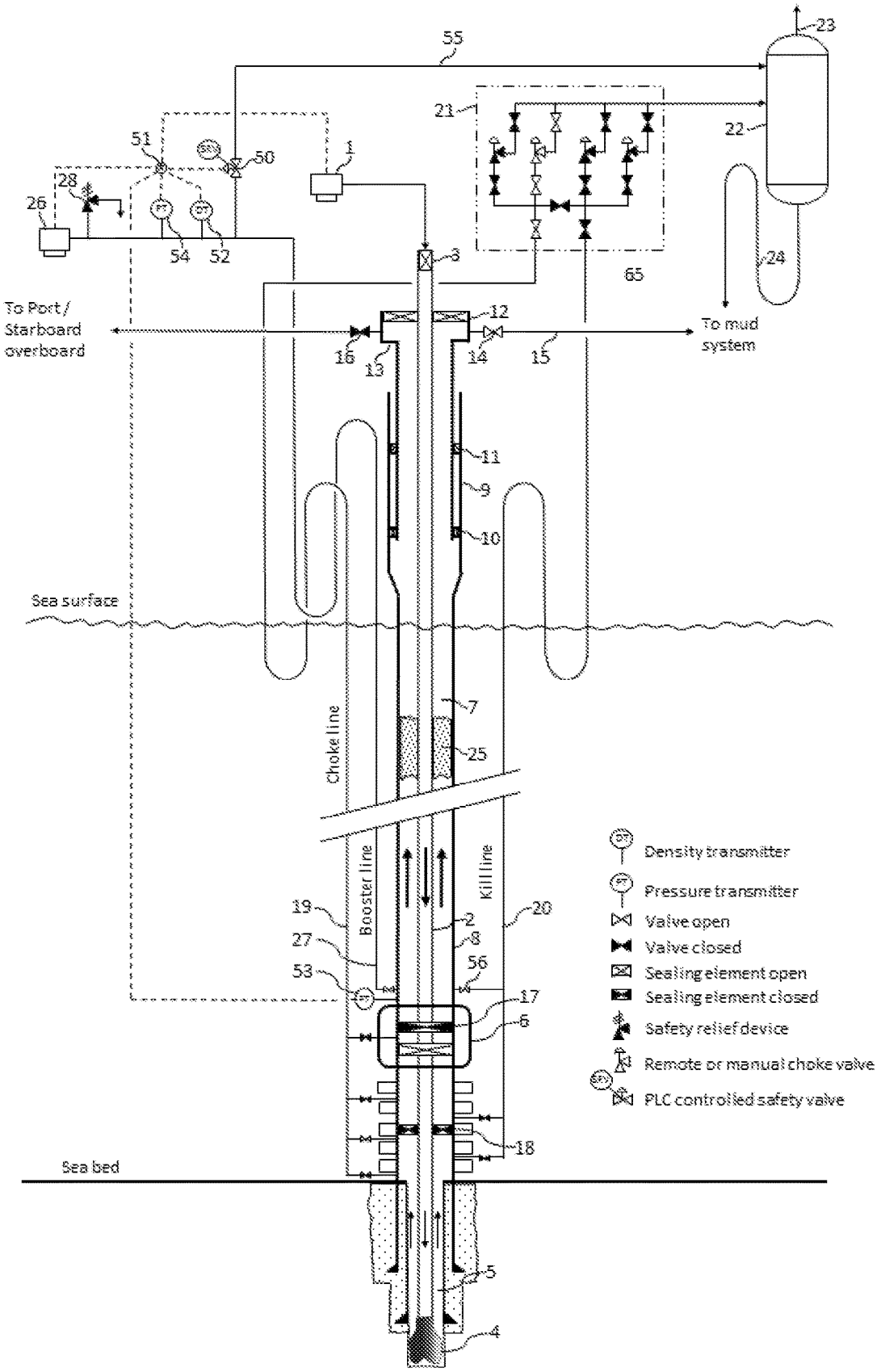
FIG. 2 discloses a simplified schematic of an offshore system as in FIG. 1, but with additional features for an embodiment of the present invention for a rig drilling with conventional pressureless mud return.

FIG. 2 discloses a simplified schematic of an offshore system as in FIG. 1, but with additional features for an embodiment of the present invention for a rig drilling with conventional pressureless mud return. In an embodiment of the present invention, the booster line 27, alternatively a separate additional line (not shown), is utilized for rapid pressure relief and/or fluid bypassing the hydrate plug 25 to prevent an uncontrolled pressure build-up across the hydrate plug 25 or resulting in max allowable working pressure (MAWP) of said drilling riser 8 being exceeded, in the event the riser annulus 7 or riser outlets is/are restricted, plugged or blocked. In an embodiment of the present invention a special safety relief valve (SRV) 50 is designed to open when the pressure exceeds a predetermined dynamically calculated value taken the frictional pressure drop and fluid density in the booster line 27 into consideration. A programmable logical controller (PLC) 51 is taken information of key variables such as the flow rate of booster pump 26, the fluid density 52 and the subsea riser annulus pressure 53, and calculates the expected booster pump outlet pressure based on fixed input data for each well such as length and internal diameter of the booster line 27. If the measured booster pump discharge pressure 54 exceeds the calculated expected booster pump discharge pressure by a predefined value, typically 100 psi, the PLC should automatically reduce the booster pump 26 flow rate until the difference between the measured and calculated discharge pressure falls below 100 psi. Simultaneously the PLC should also give an alarm and notify the operator. If the reduction in booster pump flow rate does not reduce the pressure difference below 100 psi, this can be due to a blocked, plugged or restricted riser annulus 7 or riser outlets and the PLC should automatically stop the booster pump 26, open the PLC controlled safety relief valve (SRV) 50 and give an alarm to the operator. The SRV 50 discharge line 55 should be routed to the mud gas separator 22 or to an alternative safe location. The system will typically be calibrated for each well and water depth by pumping seawater through the booster line 27 and up the riser annulus 7 after the drilling riser 8 and subsea BOP 18 are fluidly connected to the subsea wellhead. If reliable data for the subsea riser annulus pressure 53 is not available, this pressure can be calculated by the same PLC based on annulus fluid flow rate and estimated annulus fluid density, etc.

While typically the booster line is used to relive pressure or by-pass fluids in case of a blockage or restriction of the riser annulus, the best solution will be to avoid hydrates forming. The kill line 20 should therefore be filled with hydrate inhibitor, typically some kind of glycol, and the inside volume of the kill line will then act as additional storage volume when hydrate is not being injected. In a well control event hydrate inhibitor can then immediately and effectively be injected into the subsea wellhead and BOP stack to prevent hydrates to form in the subsea BOP. Hydrate inhibitor can also be injected through the kill line 20, during conventional circulation of a kick, up the choke line 19 to prevent the choke line 19 being plugged by hydrates. Another feature of an embodiment of the present invention is therefore to utilize the kill line 20 for injecting hydrate inhibitor also into the riser annulus 7 by introducing a new line and isolation valve 56, in the event the upper BOP annular 17 is closed in a well control event and gas inadvertently has entered the riser 8.

Figure 3:
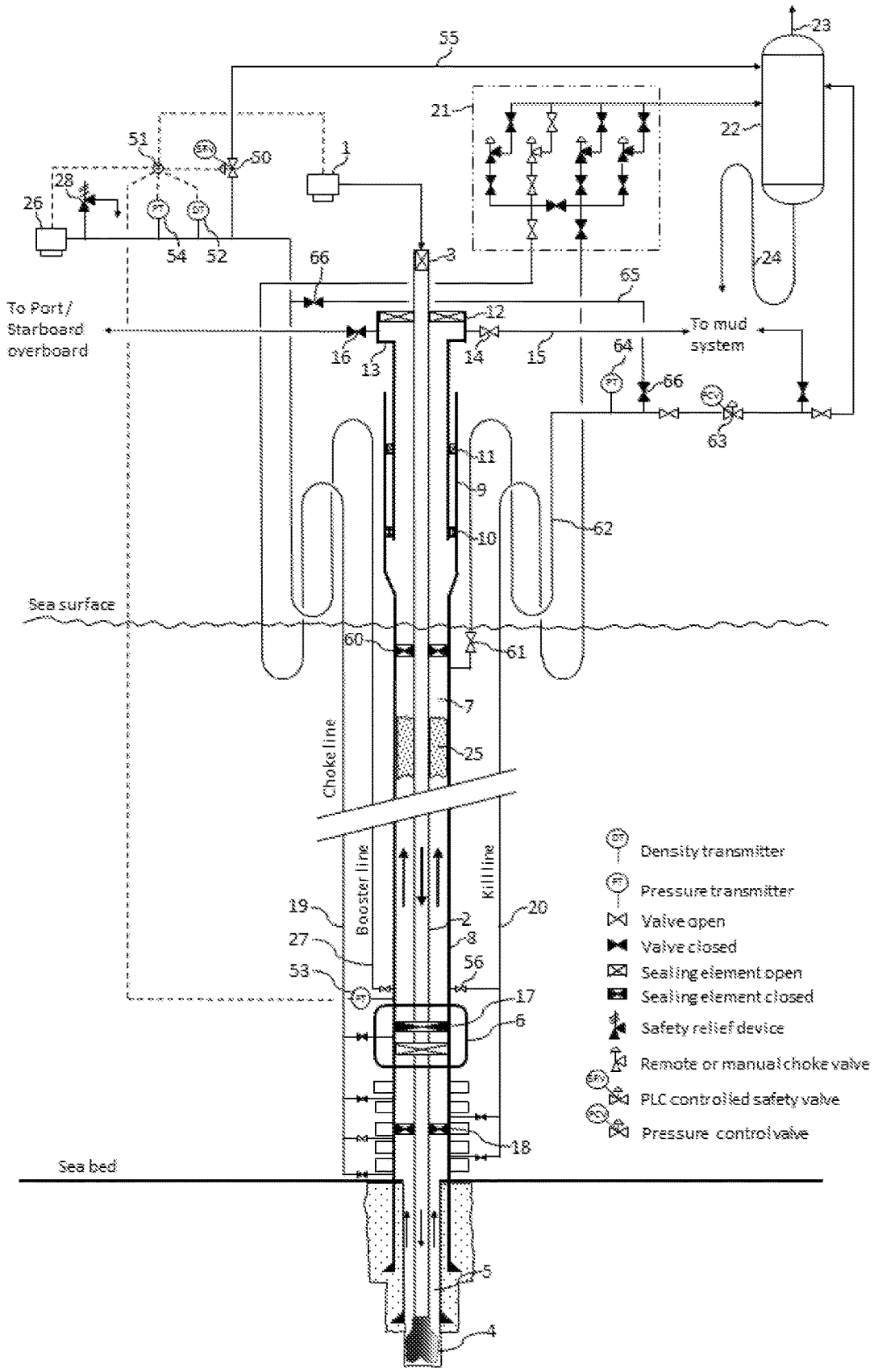
FIG. 3 discloses a simplified schematic of an offshore system as in FIG. 2, but with additional features for an embodiment of the present invention for a rig, using managed pressure drilling (MPD) or riser gas handling (RGH) technics with a pressurized mud return.

FIG. 3 discloses a simplified schematic of an offshore system as in FIG. 2, but with additional features for an embodiment of the present invention for a rig using managed pressure drilling (MPD) or riser gas handling (RGH) technics with a pressurized mud return. When utilizing these types of technics a rotating control device (RCD) 60 or some kind of sealing element to close around the rotating drill string 2 and by that deliberately closing the normal riser annulus 7 return is used. The RCD 60 is normally located below the slip joint 9. The return from the riser is normally going through at least one isolation valve 61, a flexible hose 62 and through a pressure control valve (PCV) 63. The PCV 63 is used to rapidly change applied surface back pressure (ASBP) and the ASBP is monitored by a pressure transmitter 64. After the PCV the returns can be routed either directly back to the mud system or alternatively through a mud gas separator (MGS) 22. When utilizing these technics the complexity of the system and the nature of the technics by deliberately applying surface back pressure on the riser annulus return, increase the likelihood of malfunction and mal operation resulting in overpressure of the riser.

In principle the present invention works in the same way as described in the detail description of FIG. 2 above, but with a small difference. Since one of the intensions is to avoid building up high differential pressure across a potential hydrate plug 25 the same ASBP should be applied on both sides. If the density of the fluid in the booster line 27 is the same as the density in the riser annulus 7, then the static surface pressure 54 in the booster line should be the same as the static shut-in pressure on the return side 64, and this should be taken into consideration when the dynamically calculated opening pressure of the PLC controlled safety valve 50 is calculated by the PLC 51.

Another advantage with MPD and RGH is that the ASBP can rapidly be manipulated and this will instantly also change the pressure in the riser annulus 7. When a riser booster pump 26 is used to circulate gas up and out of the riser annulus 7, the pump rate and the ASBP can be used in combination or separately to control how rapid the gas will expand during the process of RGH. The same technic can be used in riser hydrate handling (RHH). When the hydrates are circulated up the riser annulus 7, they will not expand at all until the hydrates gets to a region in the riser 8 where the pressure is low enough and the temperature is high enough allowing the hydrates to dissociate or melt. Depending on the amount of hydrates and speed they dissociate a very rapid gas expansion may occur. Pump rate and ASBP controls the speed of hydrate dissociation and gas expansion. When hydrates melt and gas expand this is and endothermic process, which means that the melting process absorbs heat or cool down the surrounding. If the circulation is stopped at the region in the riser where hydrates start to dissociate or melt, the hydrates may agglomerate and adhere to the drillstring 2 as the drillstring 2 typically will be cooled down due to the endothermic melting process. The risk of partially or completely plug the riser annulus 7 will increase. If the riser annulus 7 plugs up with hydrates 25 there will be a risk of trapped gas from the melting process will build up a pressure below the hydrate plug 25 and released gas above the plug will be vented out through the pressure control valve 63 and the mud gas separator 22, creating a large differential pressure across the hydrate plug 25. In order to dissociate or melt a hydrate plug 25 it is important that the pressure is lowered in a controlled manner on each side of the hydrate plug. This can be achieved by installing an equalising line 65 between the booster pump 26 discharge line and the mud return line, to apply the same ASBP 64 on both side of the plug. The equalising line 65 needs to be fitted with one or two isolation valves 66 which will normally be closed during normal MPD or RGH operations. In this way the pressure on both sides of the hydrate plug 25 can be regulated by one common pressure control valve 63 and if this valve fails, plug or capacity exceeded, the PLC controlled safety valve 50 can act as a secondary protection against overpressure of the riser 8. The PLC controlled safety valve 50 will also protect the riser from overpressure if the equalising line 65 and isolation valves 66 are open two late or not open resulting in pressure building up below the hydrate plug 25.

The same type of drilling riser protection system as described in FIG. 3 may also be used in connection with other MPD technics, such as WO 2009/123476 A1 (Børre Fossli).

The present invention has been described in non-limiting embodiments. It is clear that the person skilled in the art may make a number of alterations and modifications to the described embodiments without diverging from the scope of the present invention as defined in the attached claims.

What is claimed is:

1. A protection system for a drilling riser, the drilling riser comprising a main drilling riser bore and a drilling riser annulus and being configured to extend from a floating installation to a location on a seafloor and to be fluidly connected to a subsea BOP stack which comprises at least two BOPs, the system comprising:

a choke line which extends from a choke manifold on the floating installation to the subsea BOP stack below at least one BOP of the at least two BOPs in the subsea BOP stack; and a fluid conduit which extends from the floating installation to a port in a lower region of the drilling riser which is adjacent to the sea bed and above each of the at least two BOPs in the subsea BOP stack, the fluid conduit being fluidly connected with the drilling riser annulus via the port, wherein, the fluid conduit is configured to provide at least one of a rapid pressure relief and a fluid bypass which is operable to drain from the drilling riser annulus via the port and the fluid conduit to prevent the drilling riser from an uncontrolled pressure build-up due to an inadvertent plugging or a restriction resulting in a maximum allowable working pressure (MAWP) of the drilling riser being exceeded, if a restriction, a plug or a blockage exists in the drilling riser annulus or in riser outlets, the fluid conduit is fluidly connected to a mud gas separator via a pressure relief device which is configured to open when the pressure in the fluid conduit exceeds a predetermined value to so as to allow a flow of fluid from the drilling riser annulus to the mud gas separator via the port and the fluid conduit, and the fluid conduit is fluidly connected to a booster pump which is configured, in a normal use, to pump fluids down the fluid conduit into the drilling riser annulus via the port.

2. The protection system as recited in claim 1, wherein the fluid conduit is a drilling riser booster line.

3. The protection system as recited in claim 2, wherein, the pressure relief device is a safety relief valve, the booster pump is further configured, in the normal use, to automatically reduce and to completely stop a flow rate, and the safety relief valve is configured to open to drain the fluid from the drilling riser annulus via the drilling riser booster line when a pressure exceeds a predetermined dynamically calculated value under consideration of a frictional pressure drop and a fluid density in the drilling line booster line and in the drilling riser annulus during an operation of the booster pump.

4. The protection system as recited in claim 2, further comprising:

at least one isolation valve fluidly connected to the fluid conduit, the at least one isolation valve(s) being configured to open either manually or automatically so as to prevent an uncontrolled differential pressure to build up across a restriction, a hydrate plug or a blockage in the drilling riser.

5. The protection system as recited in claim 2, further comprising:

at least one fluid line configured to extend from a surface location to the lower region of the drilling riser and to be fluidly connectable to the drilling riser annulus, the at least one fluid line being a standby line at least partly filled with a hydrate inhibitor.

6. The protection system as recited in claim 5, wherein the at least one fluid line is further fluidly connectable to a wellbore and casing annulus either below or above the subsea BOP.

7. The protection system as recited in claim 5, further comprising:

a booster pump configured to pump fluids down the drilling riser booster line so as to circulate any potential gas or gas hydrates up through the drilling riser annulus, wherein, the at least one fluid line is configured to inject the hydrate inhibitor into the drilling riser annulus at the same time as the booster pump is used to pump fluids down the drilling riser booster line so as to circulate any potential gas or gas hydrates up through the drilling riser annulus.

8. The protection system as recited in claim 5, wherein, the at least one fluid line is configured to inject the hydrate inhibitor, and the at least one fluid line is an existing kill line or a choke line.

9. The protection system as recited in claim 8, wherein the choke line or the kill line is used to circulate any potential gas or gas hydrates up to a choke & kill manifold at the same time as the hydrate inhibitor is injected via an other of the choke line, the kill line or the at least one fluid line into the subsea BOP.

10. A drilling riser comprising the protection system as recited in claim 1.

11. A protection system for a drilling riser, the drilling riser comprising a main drilling riser bore and a drilling riser annulus and being configured to extend from a floating installation to a location on a seafloor and to be fluidly connected to a subsea BOP stack which comprises at least two BOPs, the system comprising:

a choke line which extends from a choke manifold on the floating installation to the subsea BOP stack below at least one BOP of the at least two BOPs in the subsea BOP stack; and a drilling riser booster line which extends from the floating installation to a port in a lower region of the drilling riser above each of the at least two BOPs in the subsea BOP stack, the drilling riser booster line being fluidly connected with the drilling riser annulus via the port in the drilling riser, wherein, the drilling riser booster line is configured to provide at least one of a rapid pressure relief and a fluid bypass which is operable to drain from the drilling riser annulus via the port and the drilling riser booster line to prevent the drilling riser from an uncontrolled pressure build-up due to an inadvertent plugging or a restriction resulting in a maximum allowable working pressure (MAWP) of the drilling riser being exceeded, if a restriction, a plug or a blockage exists in the drilling riser annulus or in riser outlets, the drilling riser booster line is fluidly connected to a mud gas separator via a pressure relief device which is configured to open when the pressure in the drilling riser booster line exceeds a predetermined value to so as to allow a flow of fluid from the drilling riser annulus to the mud gas separator via the port and the drilling riser booster line, and the drilling riser booster line is fluidly connected to a booster pump which is configured, in a normal use, to pump fluids down the drilling riser booster line into the drilling riser annulus via the port.

12. The protection system as recited in claim 11, wherein, the pressure relief device is a safety relief valve, the booster pump is further configured, in the normal use, to automatically reduce and to completely stop a flow rate, and the safety relief valve is configured to open to drain the fluid from the drilling riser annulus via the drilling riser booster line when a pressure exceeds a predetermined dynamically calculated value under consideration of a frictional pressure drop and a fluid density in the drilling riser booster line and in the drilling riser annulus during an operation of the booster pump.

13. A protection system for a drilling riser, the drilling riser comprising a main drilling riser bore and a drilling riser annulus and being configured to extend from a floating installation to a location on a seafloor and to be fluidly connected to a subsea BOP stack which comprises at least two BOPs, the system comprising:

a choke line which extends from a choke manifold on the floating installation to the subsea BOP stack below at least one BOP of the at least two BOPs in the subsea BOP stack; and a drilling riser booster line which extends from the floating installation to a port in a lower region of the drilling riser above each of the at least two BOPs in the subsea BOP stack, the drilling riser booster line being fluidly connected with the drilling riser annulus via the port in the drilling riser, wherein, the drilling riser booster line is configured to provide at least one of a rapid pressure relief and a fluid bypass which is operable to drain from the drilling riser annulus via the port and the drilling riser booster line to prevent the drilling riser from an uncontrolled pressure build-up due to an inadvertent plugging or a restriction resulting in a maximum allowable working pressure (MAWP) of the drilling riser being exceeded, if a restriction, a plug or a blockage exists in the drilling riser annulus or in riser outlets, the drilling riser booster line is fluidly connected to a booster pump and to a mud gas separator via a pressure relief device which is provided as a safety relief valve, the pressure relief device being configured to open when the pressure in the drilling riser booster line exceeds a predetermined value to so as to allow a flow of fluid from the drilling riser annulus to the mud gas separator via the drilling riser booster line and the port, and the booster pump is configured, in a normal use, to pump fluids down the drilling riser booster line into the lower region of the drilling riser annulus via the port.

14. The protection system as recited in claim 13, wherein, the booster pump is further configured, in the normal use, to automatically reduce and to completely stop a flow rate, and the safety relief valve is configured to open to drain the fluid from the drilling riser annulus via the drilling riser booster line when a pressure exceeds a predetermined dynamically calculated value under consideration of a frictional pressure drop and a fluid density in the drilling line booster line and in the drilling riser annulus during an operation of the booster pump.

* * * * *